US008807860B2

(12) United States Patent
Rolion et al.

(10) Patent No.: US 8,807,860 B2
(45) Date of Patent: Aug. 19, 2014

(54) WRITING IMPLEMENT, AND CAP WITH INNER GROOVES FOR A WRITING IMPLEMENT

(75) Inventors: Franck Rolion, Asnieres sur Oise (FR); Laurent Beaucher, Saint Maur des Fosses (FR)

(73) Assignee: Societe BIC, Clichy (FR)

( * ) Notice: Subject to any disclaimer, the term of this patent is extended or adjusted under 35 U.S.C. 154(b) by 571 days.

(21) Appl. No.: 13/131,899

(22) PCT Filed: Nov. 25, 2009

(86) PCT No.: PCT/FR2009/052289

§ 371 (c)(1),
(2), (4) Date: May 31, 2011

(87) PCT Pub. No.: WO2010/061130

PCT Pub. Date: Jun. 3, 2010

(65) Prior Publication Data

US 2011/0236122 A1 Sep. 29, 2011

(30) Foreign Application Priority Data

Nov. 28, 2008 (FR) ..... 08 58104

(51) Int. Cl.
*B43K 23/12* (2006.01)
*B43K 25/02* (2006.01)

(52) U.S. Cl.
CPC ..... *B43K 23/12* (2013.01); *B43K 25/022* (2013.01); *B43K 23/126* (2013.01)
USPC ..... 401/246; 401/131

(58) Field of Classification Search
USPC ..... 401/131, 135, 202, 213, 243, 246, 247, 401/262
See application file for complete search history.

(56) References Cited

U.S. PATENT DOCUMENTS

| | | | | |
|---|---|---|---|---|
| 2,392,942 A * | 1/1946 | Ormsby | ..... | 401/247 |
| 5,441,356 A | 8/1995 | Cho | | |
| 5,599,127 A * | 2/1997 | Fuhrmann et al. | ..... | 401/202 |
| 5,711,626 A | 1/1998 | Kobayashi et al. | | |

(Continued)

FOREIGN PATENT DOCUMENTS

| | | |
|---|---|---|
| CN | 1117280 A | 2/1996 |
| CN | 1157220 A | 8/1997 |
| CN | 2780479 Y | 5/2006 |
| GB | 2 236 509 A | 4/1991 |

OTHER PUBLICATIONS

International Search Report (PCT/ISA/210).

*Primary Examiner* — David Walczak
*Assistant Examiner* — Joshua Wiljanen
(74) *Attorney, Agent, or Firm* — Jones Day

(57) ABSTRACT

A writing implement that includes a writing body extending from an end; a writing tip integral with the writing body, and a removable cap that covers the writing tip in a coupled position of the cap with the writing body, the cap having a bottom, a tubular wall that extends along a central axis between a first end that joins with the bottom and a second end that defines an axial opening, the tubular wall has an inner surface on which protrusions are capable of holding the cap by engagement with the writing body in the coupled position, where the inner surface of the cap has at least one groove arranged between two of the protrusions and extends to the second end of the tubular wall.

16 Claims, 3 Drawing Sheets

(56) References Cited

U.S. PATENT DOCUMENTS

| | | | |
|---|---|---|---|
| 5,716,152 | A | 2/1998 | Kudo |
| 5,911,534 | A | 6/1999 | Toyama |
| 2006/0018700 | A1 | 1/2006 | Mock |
| 2006/0210348 | A1 | 9/2006 | Wang |

* cited by examiner

WRITING IMPLEMENT, AND CAP WITH INNER GROOVES FOR A WRITING IMPLEMENT

CROSS REFERENCE TO RELATED APPLICATION

This application is a national stage application of International Application No. PCT/FR2009/052289, filed on Nov. 25, 2009, which claims the benefit of French Patent Application No. 08 58104 filed on Nov. 28, 2008, the entire contents of both applications being incorporated herein by reference.

FIELD OF THE INVENTION

The embodiments of the present invention relate to a writing implement such as an ink pen, and in particular to a writing implement that includes a writing body extending from an end having a writing tip integral with the writing body, and a removable cap covering the writing tip in a coupled position of the cap with the writing body, the cap having a bottom, a tubular wall extending along a central axis between a first end joining with the bottom and a second end defining an axial opening, the tubular wall having an inner surface on which protrusions are capable of holding the cap by engagement with the writing body in the coupled position.

BACKGROUND OF THE INVENTION

A writing implement of the above-mentioned type, such as a ballpoint pen, can store a water-based ink or any standard ink. The cap allows excessive drying of the tip to be avoided by covering the latter during periods when the implement is not in use. Sealing relative to the outside can be achieved by means of an annular contact of the tubular wall of the cap on an end of the writing body adjacent to the writing tip. In some cases, the cap comprises an inner cap covering the writing tip only.

However, when the body of the writing implement is coupled to the cap, the air inside the cap is compressed, thus generating a pressure increase inside the cap that may sometimes be noticed by some users. When the cap is removed, the air pressure prevailing inside the cap is suddenly reduced, causing a release and pumping of the ink. As the cap is alternately coupled with and removed from the body of the writing implement during normal use, a significant quantity of ink can be released and risks being wasted, for example by remaining clogged in the baffles of an air vent cavity. The inventors found that this phenomenon could be noticeable whenever a liquid ink is used, whether in a free ink reservoir or also in the case of liquid ink stored in a fiber buffer.

A solution for equalizing the internal pressure in the cap consists of making a hole opposite the opening. The document U.S. Pat. No. 5,441,356 thus provides for an air passage in order to avoid pressurizing the inside of the cap when it is fitted onto a pen body. This passage is formed at the bottom of the cap and closed by a sealing valve combined with a spring. With this type of device, air can exit through the hole just prior to the coupling and the spring makes it possible to close off the air passage when the cap is held fixed on the pen body. Several localized inner protrusions of the cap maintain the closed-off position by engaging with a ring-like projection formed on the outer periphery of the pen body.

A drawback of this type of writing implement is the complexity of the sealing system which requires several pieces, including a spring, Assembly of the cap is then more expensive, limiting the appeal of pens that include such a system.

SUMMARY OF THE EMBODIMENTS OF THE PRESENT INVENTION

The aim of the embodiments of the present invention is to propose a writing implement allowing losses of ink to be avoided during operations of coupling and removing the cap, and having a simple design.

For this purpose, the writing implement according to the invention is characterized in that the inner surface of the cap has at least one groove arranged between two of the protrusions and extending to the second end of the tubular wall.

Thus during a closure operation, a now of the air accumulated at the bottom of the cap towards the opening in the cap is achieved by means of the groove which extends to the second end. The groove is used as an air passage intercalated between the cap and the writing body. Thus it is possible to prevent pressurization of the cap during its fitting or negative pressure during its removal, the groove(s) performing a pressure equalizing function. In addition, this arrangement does not impede retention of the cap and the bottom of the cap can be of simple design.

According to a further feature, the writing implement comprises a sealing element integral with the cap, arranged between the at least one and the first end of the cap. The sealing element comprises for example an annular rib formed on the inner surface of the cap, at a distance from the first and second ends, the least one groove extending to a median zone of the cap and in proximity to the annular rib. Thus an annular sealing contact can be achieved with the rib in the coupled position, in order to prevent drying of the writing tip. The closeness of the groove to the annular rib intended for the sealing contact makes it possible, when the writing end of the implement enters the cap, to evacuate via the groove all the surplus air accumulated at the bottom of the cap.

According to a further feature, the writing body comprises a free ink cartridge, the cartridge comprising a reservoir and an inner cavity arranged between the writing tip and the reservoir, the cavity being in communication with the reservoir and communicating directly with the outside through an open aperture on the outside of the writing body, the cavity being suitable for absorbing a leakage of ink. Leaks can thus be avoided when using ink systems that are sensitive to pressure variations and the presence of the cap with a groove or grooves moreover limits any movement of ink during the cap removal phase. According to a further feature, at least two grooves are provided on the inner surface of the tubular wall, alternating between the protrusions and the grooves. Preferably, the protrusions are at least three in number and distributed in a circular fashion, wherein the number of grooves may be equal to the number of the protrusions. Each of the grooves extends in a general direction parallel to the central axis and the set of grooves defines the apices of a regular polygon at the axial opening. By means of this distributed layout, the air can easily escape, regardless of any relative inclination between the cap and the body of the writing implement during the fitting of the cap.

According to a further feature, each groove is adjacent to and separates two of the protrusions. Thus, the arrangement of the hollows and peaks in the circumference of the cap allows very efficient retention while still optimizing the pressure equalization effect during the fitting of the cap. In an annular zone of the cap where the protrusions are distributed, the protrusions and the grooves can then occupy more than half of the inner circumference of the cap, for example at least 75% of this inner circumference.

According to a further feature, the distance of the groove(s) relative to the sealing element is comprised between 0.1 and 0.5 mm. Thus, the end of the grooves is closest to the sealing zone of the cap. By virtue of the arrangement of the grooves (the length of which can correspond to 40% or more of the depth of the cap), the volume of air that can be evacuated via the grooves is greater and the air compressed at the bottom of the cap can escape throughout the insertion of the writing body into the cap, even when the grip portion of the writing body is closely surrounded by the cap. Too great a proximity is however avoided so as not to cause a non-uniform deformation of the sealing element.

According to a further feature, the writing body has a cylindrical grip surface adjacent to the writing tip, this grip surface having a protruding ring-like projection in order to cooperate with the protrusions, the protruding projection being arranged opposite the writing tip in order to allow the grip surface to be completely covered by the cap. The protrusions are then arranged close to the second end.

Thus retention by the protrusions, preferably close to the opening of the cap, corresponds to fixing with material-to-material contact, for example plastic-to-plastic, which results on completion of fitting the cap, when the major part of the air initially contained in the cap has been evacuated. The grooves are elongated and produced in a cap which typically has a length greater than 2 cm, preferably greater than 4 cm, so as to cover the grip portion of the writing body used when writing.

According to a further feature, the outer surface of the tubular wall of the cap is smooth, at least towards the second end, the cap having a circular cross section. The cap is thus easy to grip and has a surface without ridges which is more pleasant to the touch. There is therefore a difference in form between the smooth outer surface and the grooved inner surface. The thickness of the cap remains small and can vary for example between a maximum of the order of 1 min and a minimum of the order of 0.6 mm. In each groove, the cap can thus have a thickness comprised between 40% and 70% of the general thickness of the cap.

According to a further feature, the writing body has an annular shoulder with an axial face in contact with the second end of the cap in the coupled position. Thus with the cap closed, the writing implement has a normal external appearance, as the shoulder on which the cap rests makes it possible to at least partially close off the grooves formed inside the cap.

According to a further feature, the writing body comprises a cartridge and a barrel partially covering the cartridge opposite the writing tip, the cartridge having a male thread allowing the barrel to be fixed, the shoulder being formed by one end of the barrel. Thus, a barrel typically without an outer protrusion and pleasant to handle for the user can advantageously be arranged in the extension of the cap and close off the outlet of each of the grooves.

BRIEF DESCRIPTION OF THE DRAWINGS

Other features and advantages of the invention will become apparent during the following description of several embodiments, given by way of non-limitative examples, with reference to the attached drawings, in which.

DESCRIPTION OF PREFERRED EMBODIMENTS OF THE INVENTION

Figure 1:
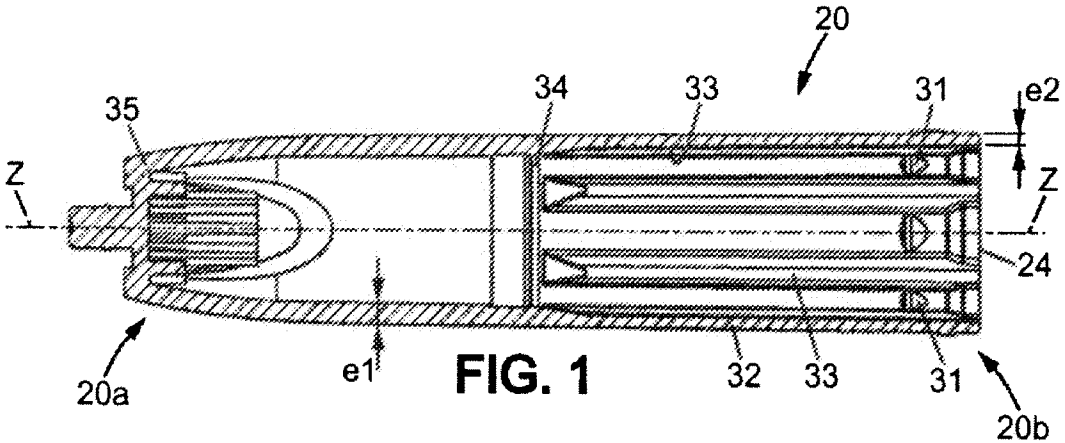
FIG. 1 is a view along a first longitudinal section of a cap body according to a preferred embodiment of the invention.

In the different figures, identical reference numbers denote identical or similar items. The writing implement 1 allows writing by any writing, erasing or highlighting medium, hereinafter called ink.

With reference to FIGS. 1, 2, 4 and 5, the writing implement 1 includes a writing body 10 and a removable cap C suitable for covering one or other of the ends (10*a*, 10*b*) of the writing body 10 in a coupled position. A writing tip 11 is mounted at one of the ends (10*a*, 10*b*) of the writing body 10. By way of non-limitative example, the writing body 10 can include a tubular portion 12 made of plastic material, which encloses an ink reserve 13 and makes it possible to house an ink feed device 14 supporting the writing tip 11.

Figure 4:
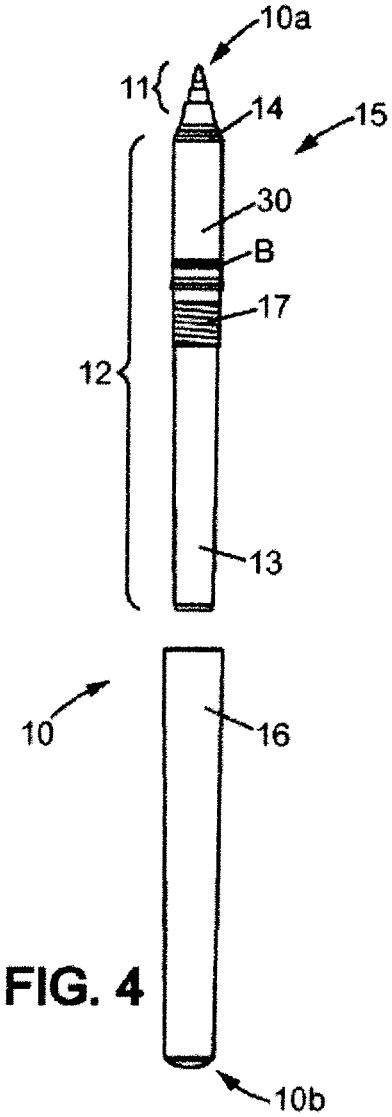
FIG. 4 is an exploded view showing a cartridge and the associated barrel constituting the body of a pen capable of cooperating with a cap according to the invention.

In the embodiment of FIG. 4, the tubular portion 12 with the ink reserve 13, the ink feed device 14 and the writing tip 11 define a cartridge 15. The cartridge 15 is inserted into a barrel 16 and can be connected permanently or removably to this barrel 16. In the example of FIG. 4, the fastening is removable and can be carried out using a male thread 17 formed externally on the tubular portion 12 of the cartridge 15. The barrel 16 can include a female thread formed on an inner wall thereof, such that the barrel 16 and the cartridge 15 can be removably fastened to each other. It is understood that a replacement cartridge can then be inserted into the barrel 16 when the ink has run out. The fastening method can be of a different type, such as for example, non-limitatively, a contact fastening by press fit, by locking. A chemical bond or an ultrasound bond can also be provided, the cartridge 15 no longer being removable from the barrel 16 in this case. Alternatively or additionally, the writing implement 1 can comprise a removable reservoir containing an ink reserve 13. This reservoir is fixed in this case in the rear of the cartridge 15.

Figure 5:
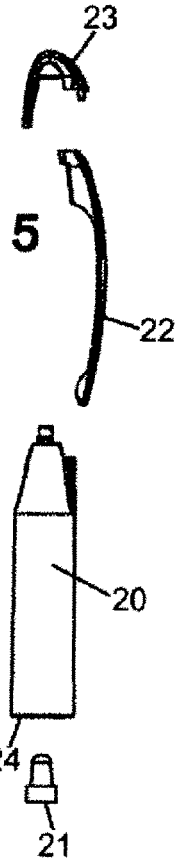
FIG. 5 is an exploded view showing elements constituting a cap according to the invention.
Figure 7:
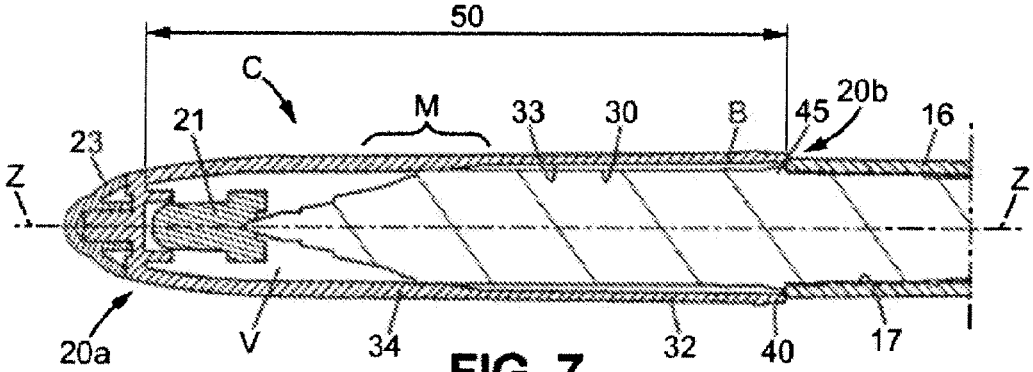
FIGS. 7 and 8 show the coupled position of the cap with the pen body.
Figure 8:
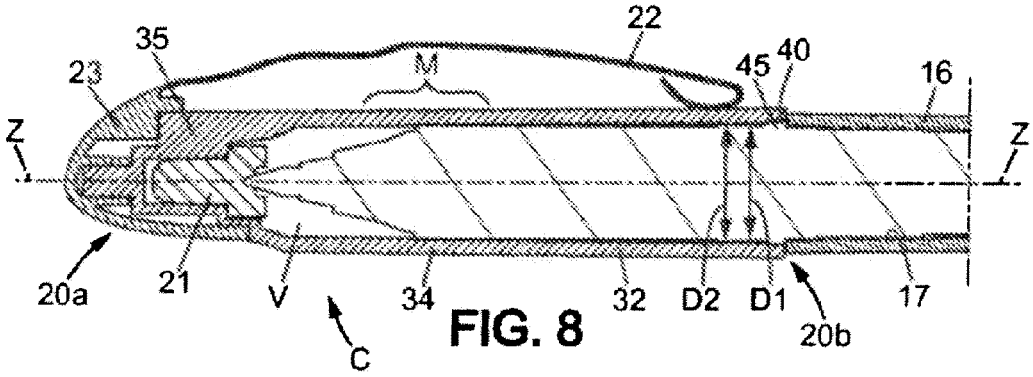

As shown in FIGS. 5, 7 and 8, the writing implement 1 comprises a cap C capable of cooperating with the writing body 10. The cap C can have a tubular cap body 20, an inner cap 21 and a clip 22, as well as an insert 23 at one end 20*a* of the cap C in order to permanently fix the clip 22 to the cap body 20. The inner cap 21 serves to prevent drying of the tip 11. It can of course be omitted in certain embodiments of the cap C. The axial opening 24 of the cap C has an inside diameter corresponding substantially to the outside diameter of the grip portion 30 of the writing body 10. This grip portion 30 can be cylindrical or have a different shape suitable for being gripped between the thumb and index finger during a writing operation. In the non-limitative example of FIGS. 4, 7 and 8, the grip portion 30 forms an integral part of the cartridge 15.

Figure 2:
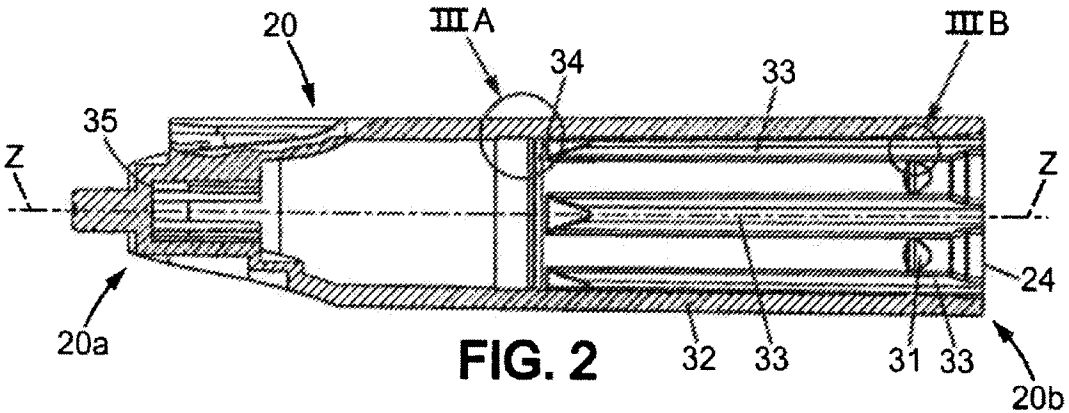
FIG. 2 is a view of the cap body of FIG. 1, along a second longitudinal section.
Figure 3A:
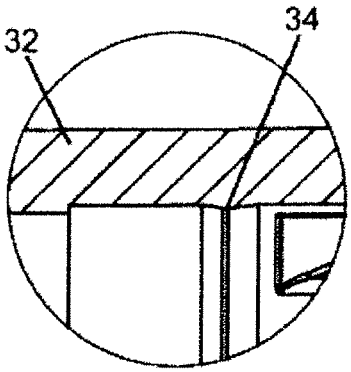
FIGS. 3A and 3B respectively show a first detail and a second detail of the tubular wall of the cap body shown in FIG. 2.
Figure 3B:
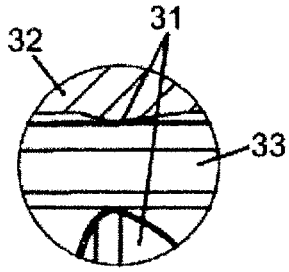
Figure 6:
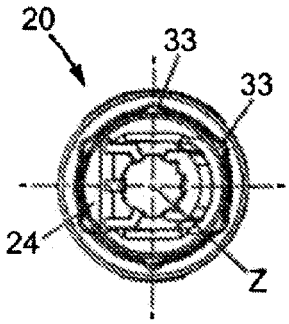
FIG. 6 is an axial view of the opening of the cap of FIGS. 1 and 2.

In a preferred embodiment of the present invention, the body 20 of the cap C has protrusions 31 which are capable of engaging with the writing body 10 when the cap C is in the coupled position. As can be seen in FIGS. 1 and 2, the protrusions 31 can be distributed in a circle close to the axial opening 24 of the cap C. These protrusions 31 are formed for example by projections protruding radially towards the central axis Z of the cap C. The tubular wall 32 of the cap body 20 also has on its inner surface one or more grooves 33 produced in the thickness of the cap body 20. These grooves 33 extend axially between a median zone M of the cap C and the end 20*b* where the opening 24 of the cap C is formed. Each of the grooves 33 is arranged between two adjacent protrusions 31. The section of each groove 33 can correspond to a "U", with a flared U-shape for example as shown in FIG. 6. The end of the grooves 33 opposite the opening 24 can have a reducing depth. In other words, the groove 33 can be formed with lateral slopes and one slope opposite the opening 24. The variation in thickness is not too abrupt. This form of groove makes it possible to avoid cavities or marks visible from outside the cap C, in particular when the wall is thin.

With reference to FIGS. 4, 7 and 8, the grip portion 30 of the writing body 10 has a cylindrical surface with a protruding ring-like projection B in order to cooperate with the protrusions 31. The ring-like projection B is here arranged opposite the writing tip 11 in order to allow the grip portion 30 to be completely covered by the cap C. In a variant, coupling means capable of cooperating with the protrusions 31 can have a different shape from a ring-like projection, for example, and non-limitatively, one or more shapes each extending over less than half of the circumference of the grip portion 30.

It will be clearly apparent from FIG. 8 that the engagement of the localized protrusions takes place when the cap C reaches its closed position, creating a lock. In this position, the protrusions 31 therefore hold the cap C on the writing body 10 so that the cap C cannot leave the writing body 10 without action by the user. As soon as the user disengages the protrusions 31 from the ring-like projection B, removal is particularly easy.

With reference to FIGS. 1 and 2, optionally, the tubular wall 32 of the cap body 20 also has on its inner surface an annular rib 34 or similar protrusion intended to seal an inner volume of the cap C situated at the bottom 35 of the cap when the cap C is fitted onto the writing body 10. The grooves 33 extend at a distance from the bottom 35, between the outlet of the cap C and a level adjacent to the annular rib 34. The position of this annular rib 34 is for example close to or merged with a transverse median plane of the cap C, and is more generally distant from the ends 20*a*, 20*b* of the cap body 20.

As can be seen in FIGS. 1, 2, 3A, 7 and 8, the annular rib 34 formed inside the cap body 20 allows the volume V of air close to the bottom 35 to be confined, preventing this air from escaping to the outside when the cap C is in the fully coupled position. The grooves 33 perform a pressure-equalizing function during the insertion of the writing body 10 into the cap C, until the moment preceding contact of the flange or annular rib 34 with the writing body 10. This contact is achieved with friction and can take place just before or at the same time as the locking of the writing body 10 by the protrusions 31. Thus at the latest when the protrusions 31 are engaged on the ring-like projection B of the writing body 10, the volume of air V surrounding the writing tip 11 is sealed. FIGS. 7 and 8 show the median zone M where the sealing barrier can typically be formed.

The grooves 33 do not obstruct the retaining function of the protrusions 31 because they alternate with the protrusions 31. Each of the grooves 33 thus extends in a general direction parallel to the central axis Z. Each of the grooves 33 constitutes a passage allowing the accumulated air close to the bottom 35 of the cap C to escape through the large axial opening 24. Non-limitatively, the number of grooves 33 can be greater than or equal to three. In the embodiment of FIG. 6, six grooves 33 are formed in the thickness of the tubular wall 32 of the cap body 20. These grooves 33 thus form the apices of a regular hexagon at the axial opening 24 of the cap C. Of course, the angular gap between the grooves can be different from 60°.

With reference to FIGS. 1-2 and 6-8 showing the inside of the cap C, the protrusions 31 are distributed in circular fashion. In the example shown, the cap has a circular section. In this case there is an imaginary circle in contact with the set of protrusions 31 which is inscribed in a transverse plane, preferably perpendicular to the axis Z and having a diameter D1 strictly less than the diameter D2 of the ring-like projection B. The protrusions 31 and the grooves 33 extend for example at least over 75%, preferably at least over 90%, of the inner circumference of the cap C. In FIGS. 1 and 2, each of the grooves 33 separates two adjacent protrusions 31. The gap between two successive protrusions 31 can thus substantially correspond to the width of a groove 33.

The outer surface of the tubular wall 32 is preferably smooth, at least towards the opening 24 of the cap C. More generally, no slot or similar longitudinal protrusion appears opposite the grooves 33 and the latter are arranged wholly within the cap C. The absence of roughness on this wall 32 makes gripping the writing implement 1 more pleasant to the touch for the user. The barrel 16 of the writing implement 1 can cooperate with the cartridge 15 and adopt a position opposite the outlet of the groove 33, as shown in FIGS. 7 and 8. By way of example, the barrel 16 can have an outer diameter substantially equal to the outer diameter of the cap C, or slightly less, while still closing the outlet of each of the grooves 33.

In an optional embodiment, a seal inside the cap C can be made by an annular sealing contact between the barrel 16 and the end 20*b* of the cap body 20. In order to achieve this, a sealing coating or a gasket (not shown) can optionally be fixed, or placed adjacent to, the end of the barrel 16 close to the grip portion 30 of the writing body 10. This seal can supplement or replace the seal created by the annular rib 34. It is understood that the seal inside the cap C can thus be achieved by a sealing contact between the annular edge at the end 20*b* of the cap C and a shoulder 40 of the writing body 10. This annular shoulder 40 with an axial face which here is in contact with the second end 20*b* of the cap C in the coupled position can alternatively simply serve to extend the cap C and at least partially close off the outlet of the grooves 33, without the contact being sealing. This shoulder 40 can be formed integrally with the cartridge 15 or by a ring.

In the example of FIGS. 7 and 8, the cartridge 15 has a male thread 17 allowing the barrel 16 to be fixed and is provided with a radial annular protrusion 45 close to this thread 17. The annular protrusion 45 defines a stop for the barrel 16 fully screwed onto the cartridge 15. The barrel 16 then acts as a stop for the cap C when the protrusions 31 are engaged at the rear of the ring-like projection B, as shown in FIG. 8. In a variant embodiment, the axial locking of the cap C can be carried out at the cartridge 15. As shown in FIGS. 1, 2 and 8, the cap C may be provided with an enlarged inside diameter towards the second end 20*b*. This allows adaptation to the annular protrusion 45.

At each of the grooves 33, the thickness e2 can be comprised between 40 and 70% of the general thickness el of the cap C, as can be seen in FIGS. 6, 7 and 8. The air passage sectional height can be maximized. In the case of an injection-moulded plastic cap C, the remaining thickness e2 can be limited to approximately 0.6 mm, this thickness remaining sufficient not to create a filling problem during the injection. It is understood that only non-continuous portions of the ring-like projection B formed on the writing body 10 are in contact with the cap C when the latter is in coupled position.

Non-limitatively, the length of the cap C may be of the order of at least 2 cm and preferably at least 4-5 cm. The protrusions 31 are close to the end delimiting the axial opening 24 of the cap C and the distance with respect to the edge of the opening 24 represents for example from 10 to 25% of the length of the grooves 33. Thus it is only at the end of travel, during the coupling operation of the cap C, that the protrusions 31 engage on the ring-like projection B or any other fastening element formed on the rear of the grip portion 30 of the writing body 10. It is understood that the length of the grooves 33 can correspond substantially to the length of the grip portion 30 of the writing body 10, formed between the ring-like projection B or similar and the upper end of the tubular portion 12 where the writing tip 11 is fixed. In the embodiment of the figures, the length is the same for the different grooves 33 and represents at least 40% of the depth 50 of the cap C. More generally, the length of each groove 33 depends on the architecture of the writing body 10 and can also be adjusted according to the overall shape of the cap C.

The cartridge 15 shown in FIG. 4 can include a device 14 for feeding ink to the writing tip, combined with a cavity suitable for absorbing a leakage of ink (not shown). The portion of the cartridge 15 covered by the barrel 16 corresponds substantially to the ink reservoir and the cavity is arranged between the device 14 and this reservoir where the ink reserve 13 is stored. The ink feed device, for example with the tubular portion 12, delimits a cavity in communication with the reservoir. This cavity communicates directly with the outside by an aperture (not shown) open to the outside. With the pressure equalization and the presence of such a cavity to absorb leakage of ink, the risk of ink leakage becomes extremely small.

One of the advantages of the invention is the ability of a cap C, typically long enough to cover a grip portion 30 of the writing body 10, to release the air trapped inside and thus carry out a pressure equalization without the design of this cap C causing problems as regards bulkiness and/or assembly.

In a variant, (not shown), the inner cap may be in the form of a cavity for receiving and enclosing the writing tip 11. The cavity of the inner cap has an opening, the rim of which extends over a contact generatrix on the end of the writing body 10. This prevents the ink from drying in the writing tip 11 without causing peripheral ink drops on the tip 11. This prevents dirtying the writing medium during a later use of the writing implement 1.

Advantageously, the inner cap can then be mounted on a spring pushing the aperture rim of the cavity of this inner cap against a radial shoulder of the writing body 10. The inner cap 21 can also be made of an elastomer material or have an elastomer-coated rim in order to provide sealing on the contact generatrix.

For writing bodies comprising a liquid ink reservoir, linked to the outside by a zigzag channel opening into the conical portion of the writing body 10, it is beneficial if the cavity of the inner cap also covers the outlet aperture of the zigzag channel.

The presence of the air evacuation grooves 33 is then particularly advantageous for preventing the ink pumping action from the reservoir of the writing implement 1.

It is understood that each of the above-described embodiment forms and details can be used on its own or in combination. It must be evident to persons skilled in the art that the present invention allows embodiments in numerous other specific forms without departing from the field of application of the invention as claimed. In particular, although the description mentions grooves 33 formed in the thickness of the cap C parallel to the central axis Z with a constant width, a person skilled in the art can appreciate that any other form of channel having a longitudinal component is suitable for allowing air to escape through the opening 24 of the cap C during the closure of the cap C. It is understood that the groove 33 produced at the inner surface of the cap C can result from an arrangement of the inside of the cap C. For example, at least one groove 33 can be formed by a slot of an inner piece of the cap C or by a spacing between different elements that are constituting parts of the inner surface of the cap C.

The invention claimed is:

1. A writing implement comprising:

a writing body extending from an end having a writing tip integral with the writing body, and a removable cap covering the writing tip in a coupled position of the cap with the writing body, the cap having a bottom, a tubular wall extending along a central axis (Z) between a first end joining with the bottom and a second end defining an axial opening, the tubular wall having an inner surface provided with a plurality of protrusions, wherein the inner surface includes a low surface level, an intermediate surface level, and an upper surface level defined by the protrusions that protrude from the intermediate surface level and are capable of holding the cap by engagement with the writing body in the coupled position, wherein the inner surface of the cap has at least one groove arranged between two of the protrusions and extending to the second end of the tubular wall, the at least one groove defining the low surface level.

2. The writing implement according to claim 1, comprising a sealing element integral with the cap, arranged between the at least one groove and the first end of the cap.

3. The writing implement according to claim 2, in which the sealing element comprises an annular rib formed on the inner surface of the cap, at a distance from the first and second end, the at least one groove extending to a median zone of the cap and in proximity to the annular rib.

4. The writing implement according to claim 3, in which the distance of the at least one groove in relation to the sealing element is comprised between 0.1 and 0.5 mm.

5. The writing implement according to claim 1, in which the writing body comprises a free ink cartridge, the cartridge including a reservoir and an inner cavity arranged between the writing tip and the reservoir, the cavity being in communication with the reservoir and opening directly to the outside through an open aperture on the outside of the writing body, the cavity being suitable for absorbing a leakage of ink.

6. The writing implement according to claim 1, in which at least two grooves are provided on the inner surface of the tubular wall, which alternates between the protrusions and the grooves.

7. The writing implement according to claim 6, in which each of the grooves is adjacent to and separates two of the protrusions.

8. The writing implement according to claim 6, in which the protrusions are at least three in number and distributed in a circular fashion, the number of grooves being equal to the number of the protrusions, each of the grooves extending in a general direction parallel to the central axis and the set of grooves defining the apices of a regular polygon at the axial opening.

9. The writing implement according to claim 6, in which the cap has a thickness at the level of each of the grooves comprised between 40% and 70% of the general thickness of the cap.

10. The writing implement according to claim 6, wherein in an annular zone of the cap where the protrusions are distributed, the protrusions and the grooves occupy at least 75% of the inner circumference of the cap.

11. The writing implement according to claim 1, in which the protrusions are arranged close to the second end and engage with a portion of the writing body distant from the writing tip.

12. The writing implement of claim 11, wherein the at least one groove extends to a median zone of the cap, the protrusions being arranged at a distance from the median zone.

13. The writing implement according to claim 1, in which the writing body has a cylindrical grip surface adjacent to the writing tip, this grip surface having a protruding ring-like projection for cooperating with the protrusions, the protruding projection being arranged opposite the writing tip in order to allow the grip surface to be completely covered by the cap.

14. The writing implement according to claim 1, in which the outer surface of the tubular wall of the cap is smooth at least towards the second end, the cap having a circular cross section.

15. The writing implement according to claim 1, in which the writing body has an annular shoulder with an axial face in contact with the second end of the cap in the coupled position.

16. The writing implement according to claim 15, in which the writing body comprises a cartridge and a barrel partially covering the cartridge opposite the writing tip, the cartridge having a male thread allowing the barrel to be fixed, the shoulder being formed by one end of the barrel.

* * * * *